United States Patent [19]

Naka

[11] 4,455,797

[45] Jun. 26, 1984

[54] STAIR NOSING

[75] Inventor: Hiromitsu Naka, Saitama, Japan

[73] Assignee: Kabushiki Kaisha Naka Gijutsu Kenkyusho, Hokkaido, Japan

[21] Appl. No.: 304,259

[22] Filed: Sep. 14, 1981

[51] Int. Cl.[3] ..... E04F 11/16

[52] U.S. Cl. ..... 52/179

[58] Field of Search ..... 52/179, 188, 273, 277, 52/254, 288; 16/8, 10, 11

[56] References Cited

U.S. PATENT DOCUMENTS

| | | | |
|---|---|---|---|
| 1,767,782 | 6/1930 | Awbrey | 52/179 |
| 2,847,732 | 8/1958 | Hyman | 52/179 |
| 2,881,485 | 4/1959 | Hyman | 52/273 |
| 3,208,095 | 9/1965 | Hill | 52/273 |
| 3,710,414 | 1/1973 | Fuller et al. | 16/8 |
| 4,318,951 | 3/1982 | Naka et al. | 52/288 |
| 4,321,293 | 3/1982 | Naka | 52/179 |

FOREIGN PATENT DOCUMENTS

| | | | |
|---|---|---|---|
| 3197714 | 7/1956 | Fed. Rep. of Germany | 52/179 |
| 11468 | 5/1980 | European Pat. Off. | 52/179 |
| 14571 | 8/1980 | European Pat. Off. | 52/179 |

*Primary Examiner*—John L. Murtagh
*Assistant Examiner*—Andrew Joseph Rudy
*Attorney, Agent, or Firm*—Wenderoth, Lind & Ponack

[57] ABSTRACT

A stair nosing is constituted by an edge base made of a hard material and adapted to be installed on the tread of a stair step, and an edge bead cushion formed on a surface of the edge base so as to be located at the stair tread nosing of the stair step. A positioning groove is formed on the surface of the edge base behind the edge bead cushion, and a gripper is adapted to be set in the positioning groove and to be secured to the edge base. The edge base is provided with a riser cover integrally formed at the front edge thereof so as to be positioned on the riser of the step in a manner to fit over the stair tread nosing. The gripper is composed of a sheet member adapted to be positioned in the groove and a number of spaced nails projected from the surface of the sheet member.

4 Claims, 6 Drawing Figures

STAIR NOSING

BACKGROUND OF THE INVENTION

This invention relates to a stair nosing improved so as to be suitable for a stairway spread with a carpet, a felt, a mat or the like.

So far, when a carpet is continuously spread on a stairway, it is secured to the stairway by an adhesive or is fixed to the stairway by stair rods.

However, when the above carpeting method is applied to the stairway, the carpet is extremely worn away at the stair tread nosing of each stair step to make difficult its use over a long period of time. In addition, such method gives a sense of incompatibility between the carpet and the stair nosing.

Also, a carpet of this kind as disclosed in U.S. Pat. No. 2,288,470 fastened with a protective stair edging to the stair tread nosing of each step. The protective stair edging is so installed on the step from the carpet surface that the joining with the carpet becomes unstable, resulting in insufficient fastening to the step. Thus, its use is extremely dangerous as a fall or trip hazard.

Further, a stair carpet disclosed in U.S. Pat. No. 2,237,224 is spread on the stairway in such a way as to join the stair carpet with the riser carpet in consecutive order. Also, a rubber nosing with a non-skid surface is fastened to the stair tread nosing from the surface of a canvas lining. Therefore, its stability at a stair tread nosing is extremely poor, since the nosing slips out of place by applying a treading pressure and also tends to produce buckling in its riser portion due to its sticking on the canvas lining by bending it.

SUMMARY OF THE INVENTION

Therefore, one object of the present invention is to provide a stair nosing which can avoid the extreme wear of a carpet, a felt, or a mat at the stair tread nosing of a stair step, and can be used on a stairway on which a harmonized carpet, felt, or mat is spread.

Another object of the present invention is to provide a stair nosing which can be easily manufactured in a simple construction at low cost, and can be directly fastened to the stair tread nosing of a stair step, can be easily and simply secured onto the stair tread nosing of the stair step, and further can be used on a stairway to be spread with a carpet, a felt, or a mat which is firmly secured onto the stair tread nosing.

Another object of the present invention is to provide a stair nosing which can protect the stair tread nosing of a stair step, gives non-slip and cushion effects to the stair tread nosing, and further can be used on the stair step to be spread with a carpet, a felt or a mat, without presenting a trip hazard.

BRIEF DESCRIPTION OF THE DRAWINGS

The above and other objects and attendant advantages of the present invention will be more readily apparent to those skilled in the art from the following description when read in connection with the accompanying drawings, in which.

DESCRIPTION OF THE PREFERRED EMBODIMENTS

Figure 1:
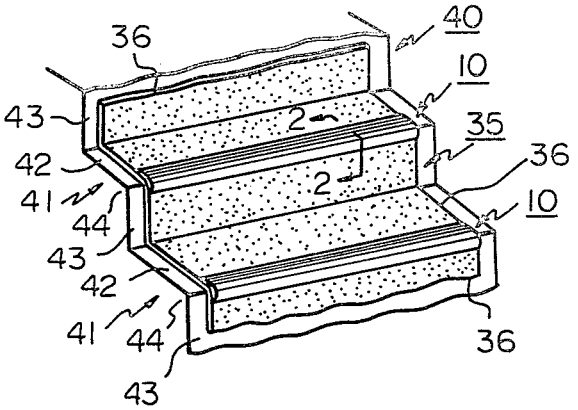
FIG. 1 is a perspective view of a preferred embodiment of stair nosing of the invention applied to a stair step to be spread with a carpet in a building.
Figure 2:
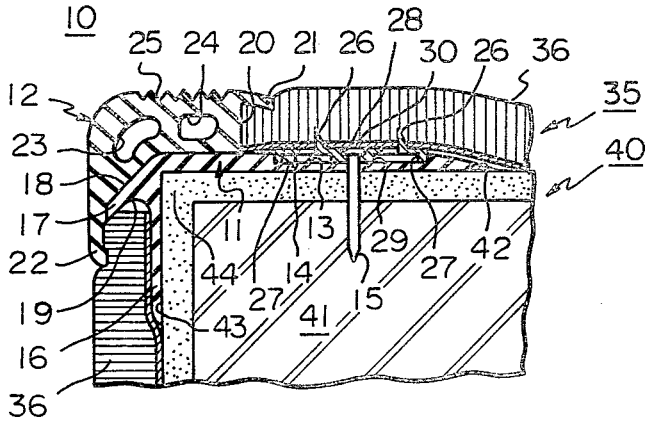
FIG. 2 is a sectional view along the 2—2 line in FIG. 1.

Referring to the accompanying drawings, and more particularly to FIGS. 1 and 2 thereof, a preferred embodiment of a stair nosing according to the present invention is generally shown by numeral 10 and is installed on the stairway 40 of a building to be spread with a carpet 35 comprising a number of pieces of carpet 36.

The stair nosing 10 includes an edge base 11 installed on the tread 42 of each stair step 41 of the stairway 40 in such a manner as to fit over the stair tread nosing 44 of the stair step 41. An edge bead cushion 12 is integrally formed on the surface of the edge base 11 so as to be located at the stair tread nosing 44 of the stair step 41. A positioning groove 13 is formed in the surface of the edge base 11 behind the edge bead cushion 12. A gripper 14 is arranged on the edge base 11 so as to be set in the positioning groove 13. A fastener 15 is driven into the stair step 41 so as to fasten the edge base 11 together with the gripper 14 on the tread 42 of the stair step 41.

The edge base 11, which may be extruded from hard synthetic resin, is provided with a riser cover 16 integrally formed at the front edge thereof so as to be positioned on the riser 43 of the stair step 41 in such a such a manner as to fit over the stair tread nosing 44 of the stair step 41. Thus, the stair nosing is easily and simply secured onto the stair tread nosing 44 of the stair step 41.

The edge base 11 preferably is thin so as to obtain practically a gentle slope of the carpet piece 36 when it is fastened on the edge base 11 by the gripper 14.

The edge base 11 is, further, provided with a front flange 17 integrally formed at the front edge thereof and extended toward the front of the riser 43. In addition, the front flange 17 is provided with an inclined upper surface 18 downwardly inclined toward the front of the riser 43 and also a catching groove 19 formed on the under surface thereof.

The so shaped front flange 17, without projecting upwardly far from the tread 42 of the stair step 41 and without projecting very far forwardly from the front of the riser 43 of the stair step 41, improves the cushion effect and durability of the edge bead cushion 12 by thickening the edge bead cushion 12 which is integrally formed on the inclined upper surface 18 and at the front side of the upper surface of the edge base 11, and further effectively prevents the stair tread nosing 44 from being scratched.

The edge bead cushion 12 made of soft synthetic resin or semi-hard synthetic resin is integrally formed with the front side of the upper surface of the edge base 11 and the inclined upper surface 18 of the front flange 17. A flexible tread side cover flap 21 projects rearwardly from a abutting surface 20 of edge bead cushion 12 so as to be capable of covering the edge of the carpet 36 to be jointed on the abutting surface 20. A flexible riser side cover flap 22 projects downwardly from the front of the edge bead cushion 12 in such a manner as to cover the front flange 17. Thus the flexible riser side cover flap 22 covers the upper edge of the carpet 36 inserted into the catching groove 19.

Thus, cushion 12 is placed so as to match with the abutting surface 20 and catching groove 19 respectively. In addition, cushion 12 covers the front and upper edges of the pieces of carpet 36 to be inserted, thereby avoiding over-locking of the edges of pieces 36.

The edge bead cushion 12 is an elastic construction having hollow portions 23 and 24. Thus, cushion 12 has an improved cushion effect, and also has an improved non-slip effect by forming a cross sectional tooth-shaped non-skid top surface portion 25.

The positioning groove 13 is extended in the longitudinal direction of the edge base 11 behind the edge bead cushion 12 and is formed on the upper surface of the edge base 11.

The groove width of the positioning groove 13 is so matched with the plate width of the gripper 14 that the gripper 14 is set into the groove, and a gentle slope on the pieces of carpet 36 to be fastened is maintained by limiting the projection of the upper surface of the gripper 14 to the utmost beyond the upper surface of the edge base 11.

The gripper 14 is a plate-shaped gripper member, and in this case is roll-formed from a sheet-metal member as a metal strip. That is, the gripper 14 is composed of the sheet-metal member adapted to be positioned in the positioning groove 13, a number of spaced nail-shaped members 26 shear-formed in the sheet-metal member so as to project from the upper surface of the sheet-metal member and a pair of lips 27 extending downwardly from opposite sides of the sheet-metal member.

Also, the gripper 14 is provided with a driving groove 28 formed on the upper surface of the metal strip for fastener 15 by extending the strip in the longitudinal direction at the center of the plate width.

A rib 29 corresponding to the driving groove 28 projects from the under surface of the gripper 14.

Therefore, the gripper 14 is easily placed on the edge base 11 by setting the gripper in the positioning groove 13.

Further, if the fastener or nail 15 to fasten the gripper 14 together with the edge base 11 on the tread 42 of the stair step 41 is driven into the driving groove 28, the nailing work becomes extremely easy since the gripper 14 is prevented from slipping out of place on the edge base 11 due to correct guiding of fastener 15 through the driving groove 28. Also, the head 30 of the fastener 15 is completely hidden in the driving groove 28. As a result, a difference in level or a rising of the piece of carpet 36 due to the protrusion of the head 30 can be prevented.

The fastener 15, as forementioned, is a nail to be driven into the stair step 41 on the tread 42 and tightly fastens the placed edge base 11 and gripper 14 on the tread 42, and thus, prevents the edge bead cushion 12 from slipping when trod.

Of course, the fastener 15 to be used may be different, depending on whether the stair is a wooden stair, concrete stair, etc., and it may be a special nail, wooden screw, self tapping screw, self drilling screw, or screw for concrete construction.

In the following, a method of fastening the stair nosing 10 configured as aforementioned on the stairway 40 in a building is described.

First, an adhesive is applied on the under surface of the edge base 11 and the rear surface of the riser cover 16. Then, the riser cover 16 is hung on the riser 43 of the stair step 41 and the edge base 11 is positioned at the stair tread nosing 44 of the stair step 41 by lightly touching cover 16 on riser 43. Under this condition, the edge base 11 is pressed on the tread 42 and the riser cover 16 is pressed on the riser. Thus, the edge base is fixed to the stair tread nosing 44 of the stair step 41. After fixing the edge base 11 provided with the edge bead cushion 12 and the riser cover 16, the gripper 14 is arranged on the edge base 11 while driving the gripper 14 into the positioning groove 13. Then, the fastener, namely the nail 15, is nailed through the driving groove 28 of the gripper 14 into the stair step 41 through the edge base 11, and the stair nosing 10 is fastened on the stair step 41.

After securing the stair nosing 10 on the stair step 41, the edge of the piece of carpet 36 is pressed against the abutting surface 20 by generally positioning the piece of carpet 36 on the tread 42 of the stair step 41. From this condition, the edge of the piece of carpet 36 is further pressed toward the edge base 11 and the carpet piece 36 is secured to the edge base 11 by the tapering nails 26 being inserted into the carpet piece 36.

After finishing the procedures aforementioned, the piece of carpet 36 is secured onto the tread 42 of the stair step 41 and the riser 43 of the adjacent upper stair step 41 by applying an adhesive on the under surface of the piece of carpet 36, or by using suitable fasteners. Further, on the riser 43 of the adjacent upper stair step 41, the upper edge of the carpet piece 36 is inserted in the catching groove 19 of the stair nosing 10 secured to such adjacent upper stair step 41 and then, the upper edge of the carpet piece 36 is fixed to the riser 43.

The stair nosing 10 has the function of fastening the upper edge of the carpet piece 36 by inserting the upper edge of the carpet piece 36 fixed to the riser 43 of the stair step 41 in the catching groove 19.

Thus, the stair nosing 10 is installed at the stair tread nosing 44 and secures the carpet 35 which consists of pieces of carpet 36 on the stairway 40.

Figure 3:
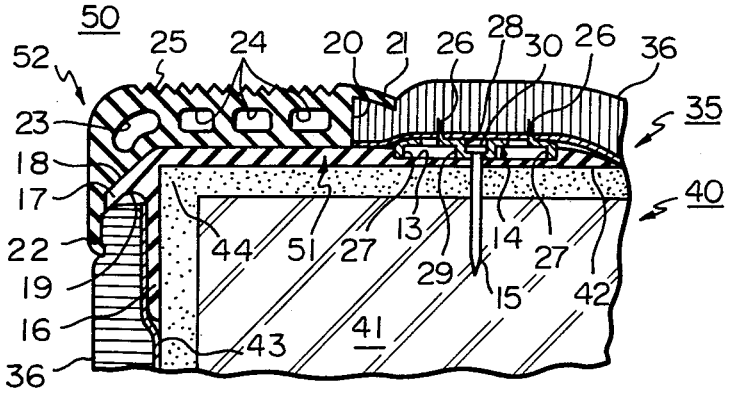
FIGS. 3 to 6 are sectional views similar to FIG. 2, of modifed embodiments of the stair nosings of the present invention.
Figure 4:
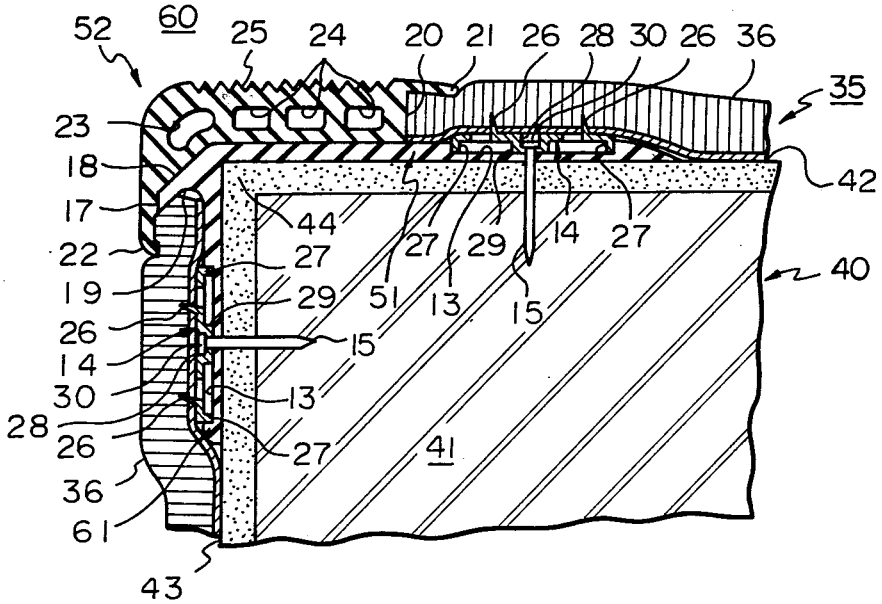

FIGS. 3 and 4 illustrate modified embodiments 50 and 60 of the stair nosing of the present invention and the installation is carried out similarly to that for the stair nosing 10 aforementioned.

The description of the members of the stair nosings 50 and 60 corresponding to those of the stair nosing 10 is omitted, and such members are designated by the same numerals.

The stair nosing 50 illustrated in FIG. 3 broadens the width of the edge bead cushion 12 of the stair nosing 10 shown in FIGS. 1 and 2.

In addition, with broadening the width of edge bead cushion 52, the widths of the edge base 11 and the non-skid top surface portion 25 are also broadened, and plural hollow portions 24 are employed.

This means that the stair nosing 50 comprises a thin edge base 51 made of hard synthetic resin integrally formed with the riser cover 16 and the front flange 17, the edge bead cushion 52 made of soft synthetic resin integrally formed on the surface of edge base 51 and front flange 17, the positioning groove 13, the gripper 14, and the nail 15.

Further, the edge bead cushion 52 is integrally formed with the flexible tread and riser side cover flaps 21 and 22 respectively.

The stair nosing 60 shown in FIG. 4 further extends the riser cover 16 of the stair nosing 50 shown in FIG. 3 so as to form a riser cover 61 for another gripper 14. Another positioning groove 13 is formed on the front surface of the riser cover 61. Grippers 14 are arrangeable on the edge base 51 and the riser cover 61, respectively.

The grippers 14 arranged on the edge base 51 and the riser cover 61 are fastened with nails 15 on the tread 42 of the step 41 and the riser 43 together with the respective edge base 51 and riser cover 61.

Also, the front and rear edges of the pieces of carpet 36 are fastened with the grippers 14 on the tread 42 and riser 43 of the stair step 41. Therefore, the grippers 14 are placed on the surfaces of the edge base 51 and the riser cover 61 respectively by matching the lips 27 with the positioning grooves 13.

Figure 5:
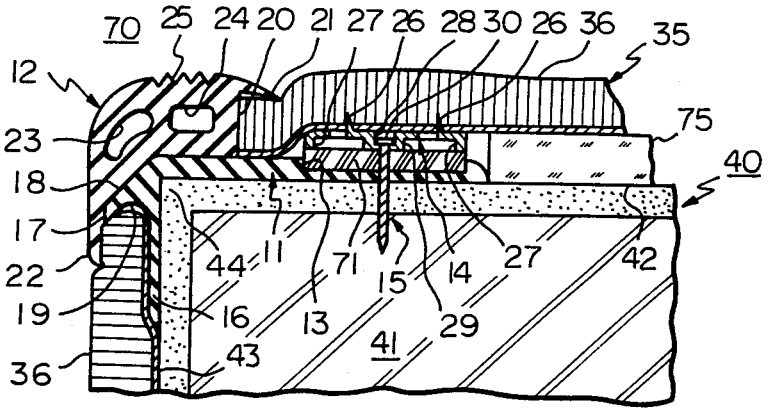
Figure 6:
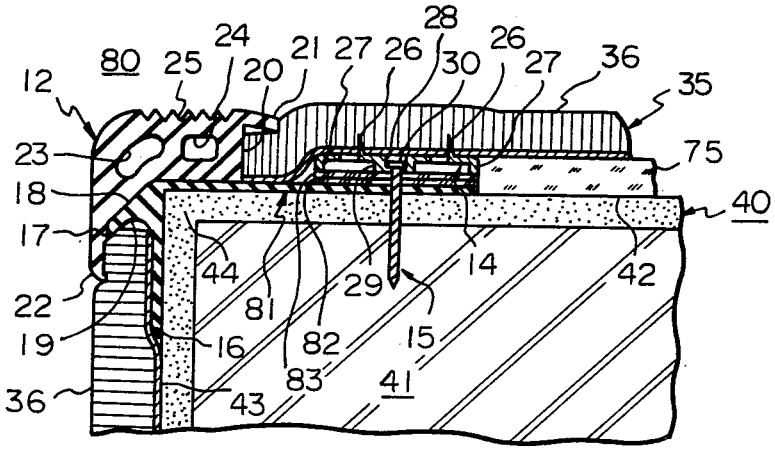

FIG. 5 and FIG. 6 illustrate modified embodiments 70 and 80 of the stair nosing of the present invention.

The stair nosing 70 or 80 is designed so as to be suitable for a building stairway 40 on which first a felt 75 is spread on the tread 42 of the stair step 41 and then, the piece of carpet 36 is spread on the felt 75.

The stair nosing 70 or 80, similarly to the stair nosing 10 aforementioned, is installed at the stair tread nosing 44 of the stair step 41 and fastens the piece of carpet 36 on the stair step 41.

The description of the members of the stair nosings 70 and 80 corresponding to those of the stair nosing 10 is omitted, and such members are designated by the same numerals.

The stair nosing 70 shown in FIG. 5, compared to the stair nosing 10, is designed to absorb the thickness of the felt 75 using a liner 71 which is inserted between the edge base 11 and the gripper 14.

The liner 71 is processed to a specified thickness beforehand corresponding to the felt 75. It is a matter of course that the liner 71 is processed beforehand so as to have a width fitting into the positioning groove 13 on the edge base 11.

The stair nosing 80 shown in FIG. 6 is designed to absorb the thickness of the felt 75 by changing the number of liners 82 and 83 to be piled up between the edge base 81 and the gripper 14.

Therefore, the edge base 81 has a structure omitting the positioning groove 13 from the edge base 11 of the stair nosing 10.

The liners 82 and 83 aforementioned are constructed by strip plates made of metal or hard synthetic resin.

While some of the preferred embodiments of the present invention have been described with reference to the accompanying drawings, it will be understood that they are by way of example, and that various modifications and changes may be made without departing from the spirit and scope of the invention, which is intended to be defined only by the following claims.

What is claimed is:

1. A stain nosing for covering the tread nosing of a stair step, said stair nosing comprising:

an edge base formed of a hard synthetic resin material and adapted to fit on a tread portion of a stair step and to extend longitudinally along a tread nosing thereof;

a riser cover formed of said hard synthetic resin material integrally with said edge base and extending downwardly from a forward edge thereof to be positioned over a riser portion of the stair step;

a front flange formed of said hard synthetic resin material integrally with said edge base and said riser cover, said front flange extending forwardly from an upper front portion of said riser cover and from said forward edge of said edge base, said front flange having an upper surface inclined downwardly away from the riser portion, and said front flange having formed in an undersurface thereof catching groove means for receiving an upper edge of a piece of carpet adapted to cover the riser portion;

an edge bead cushion formed of a soft synthetic resin material or a semi-hard synthetic resin material integrally over a front portion of an upper surface of said edge base and over said inclined surface of said front flange;

a positioning groove formed in said upper surface of said edge base at a location rearwardly of said edge bead cushion, said positioning groove extending in the longitudinal direction of the tread nosing of the stair step; and gripper means for securing said edge base to a piece of carpet adapted to cover the tread portion of the stair step, said gripper means comprising a gripper member adapted to fit into said positioning groove and thereby be secured to said edge base, and plural spaced nail-shaped members extending upwardly from said gripper member and adapted to be inserted into a tread portion covering piece of carpet.

2. A stair nosing as claimed in claim 1, wherein said edge bead cushion includes an abutting surface at a rear side thereof for abutment with a forward edge of the tread portion covering piece of carpet, and a flexible tread side cover flap extending rearwardly from said abutting surface for covering the forward portion of the tread portion covering piece of carpet.

3. A stair nosing as claimed in claim 1, wherein said edge bead cushion includes a flexible riser side cover flap extending downwardly from a front portion thereof, said riser side cover flap covering said front flange and being adapted to cover an upper portion of the riser portion covering piece of carpet.

4. A stair nosing as claimed in claim 1, further comprising a second positioning groove formed in the forward surface of said riser cover at a location below said edge bead cushion, said second positioning groove extending in the longitudinal direction of the tread nosing of the stair step, and gripper means for securing said riser cover to a riser portion covering piece of carpet.

* * * * *